United States Patent [19]

Ono

[11] 4,437,850

[45] Mar. 20, 1984

[54] PROCESS OF MANUFACTURING OF REINFORCED CORRUGATED CARDBOARD TYPE PACKAGING CONTAINER

[75] Inventor: Masayuki Ono, Saitama, Japan

[73] Assignee: Kabushiki Kaisha Tomoku, Hokkaido, Japan

[21] Appl. No.: 310,817

[22] Filed: Oct. 13, 1981

[30] Foreign Application Priority Data

Oct. 14, 1980 [JP] Japan ..... 55-142482

[51] Int. Cl.[3] ..... B31B 1/74; B31B 49/02

[52] U.S. Cl. ..... 493/89; 493/110; 493/330; 493/332; 493/399

[58] Field of Search ..... 493/89, 110, 330, 332, 493/335, 334, 328, 399, 398, 397, 400–403, 463, 151, 161; 156/227, 205

[56] References Cited

U.S. PATENT DOCUMENTS

| | | | |
|---|---|---|---|
| 1,199,508 | 9/1916 | Swift, Jr. | 493/463 X |
| 1,591,062 | 7/1926 | Smith | 493/463 X |
| 2,144,263 | 1/1939 | Lane | 493/332 |
| 2,411,622 | 11/1946 | Guyer et al. | 493/110 X |
| 2,949,151 | 8/1960 | Goldstein | 493/335 X |
| 2,982,333 | 5/1961 | Little . | |
| 3,179,023 | 4/1965 | Hoff | 493/335 |
| 4,129,471 | 12/1978 | Rome | 156/227 X |

*Primary Examiner*—James F. Coan

*Attorney, Agent, or Firm*—Armstrong, Nikaido, Marmelstein & Kubovcik

[57] ABSTRACT

A process of manufacturing of corrugated cardboard type packaging container in which a corrugated core liner adhered at its one side surface to one side liner is applied at its other side surface with an adhesive agent and then with a reinforcing agent and thereafter is adhered to the other side liner to form reinforced corrugated cardboard, and before completion of hardening of the reinforcing agent scored lines are formed in the reinforced region of the reinforced corrugated cardboard for forming a packaging container.

3 Claims, 6 Drawing Figures

PROCESS OF MANUFACTURING OF REINFORCED CORRUGATED CARDBOARD TYPE PACKAGING CONTAINER

BACKGROUND OF THE INVENTION

This invention generally relates to a process of manufacturing of a packaging contaier such as a carton or the like made of reinforced corrugated cardboard, and more particularly relates to a process of manufacturing of a packaging container made of reinforced corrugated cardboard which has an improved pressure resisting property.

A corrugated cardboard packaging container is widely used for various packaging applications because it is light in weight and is strong in mechanical strength. But, when commodities to be contained therein are heavy in weight and the corrugated cardboard packaging container containing the commodities, are piled one upon another, there has been such a danger that the pressure applied to the container is beyond a limit of the pressure resisting strength owned by the corrugated cardboard itself and consequently there takes place deformation or breakage of the packaging container. For this reason, as seen in Japanese Utility Model Laid-open Application No. 52-84427, it has been proposed that the pressure resisting strength of a packaging container is improved by applying of a reinforcing agent to the core of the corrugated cardboard forming the four side portions the body of the packaging container.

However, in a case of using of the container of which the side portions are reinforced, when such plural containers containing heavy commodities are piled one upon another scored line portions b thereof are crushed by pressure as shown in FIG. 6, and additionally flaps c thereof are caved in inside the side portions a as shown in FIG. 5, so that the interior dimensions of the container is decreased to such an extent that the container becomes unsuitable for reuse or is liable to be broken at the scored line portions b. In the above view, the invention of this application has previously proposed such a reinforced corrugated cardboard packaging container in Japanese Utility Model Application No. 53-12420 that reinforcement treatment is carried out not only on the scored line portions b of the flap, but also to extend to the sides a of the container as shown in FIGS. 1 and 2.

It has been confirmed that in manufacturing of the reinforced corrugated cardboard packaging container, if reinforced corrugated cardboard manufactured by a conventional reinforced corrugated cardboard manufacturing process is used, the object of the reinforcement cannot be fully attained. Namely, the conventional process of manufacturing of reinforced corrugated cardboard is such that a sheet of cardboard is previously applied with a reinforcing agent, and then is formed by pressing into a corrugated core liner and thereafter the front and back liners are adhered in order to both side surfaces thereof to obtain reinforced corrugated cardboard, and thereafter the reinforced corrugated cardboard is applied with a scoring step so that scored lines are formed in the cardboard, a packaging container is formed thereby.

When the scored lines are thus formed, since the reinforcing agent of the core liner has been earlier hardened through heating and drying by a preheater and through heating during corrugation forming, the portions of the corrugated cardboard reinforced with the reinforcing agent is crushed and its structure is destroyed on forming the scored lines therein by a scorer, so that when the portions are applied with pressure in piled condition of the containers, the same is bent as shown in FIG. 6, and the purpose of reinforcing of the scored lines is meaningless.

SUMMARY OF THE INVENTION

It is therefore an object of the present invention to provide a process of manufacturing of a reinforced corrugated cardboard type packaging container in which scored line portions are reinforced without fail and its resistance to pressure is improved to overcome the shortcomings in the prior art. According to the present invention, it is characterized in that a corrugated core liner and one side liner are adhered together by corrugator, and the core liner thereof is applied with an adhesive agent and then is further applied with a reinforcing agent, and the other side liner is adhered to the core liner thereof to form reinforced corrugated cardboard, and before completion of hardening of the reinforcing agent, scored lines are formed in the reinforced region of the reinforced corrugated cardboard, and the reinforced corrugated cardboard is folded to form a packaging container.

BRIEF DESCRIPTION OF THE DRAWINGS

FIG. 1 is a pertially omitted perspective view of a reinforced corrugated cardboard type packaging container produced according to this invention, FIG. 2 is a section view thereof taken along the line II—II in FIG. 1, FIG. 3 is a schematic diagram for explanation of a manufacturing process according to this invention, FIG. 4 is a diagram showing the results of pressure resisting tests in regard to the relationships between the pressure strength and the deformation of each cardboard container.

DETAILED DESCRIPTION OF THE PREFERRED EMBODIMENTS

Figure 3:
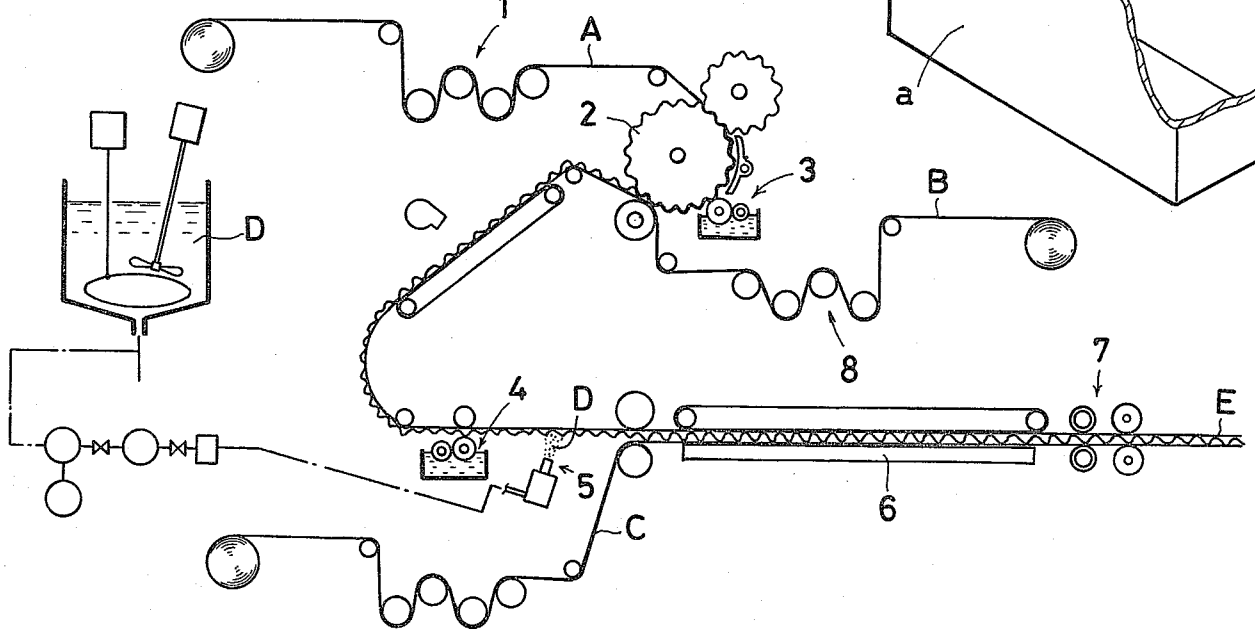

One example of a process of manufacturing of a reinforced corrugated cardboard type packing container according to this invention will now be explained with reference to FIG. 3.

In the Figure, a sheet for a core liner A is heated and dried by a preheater 1 and is press-formed into a corrugated core liner by a core forming corrugator 2 and at the same time is applied with an adhesive agent by a pasting apparatus 3 to the tops of one side surface of the corrugated core line A, and thereafter the corrugated core liner A is adhered to one side liner B which is previously heated and dried by a preheater 8. Thereafter, the corrugated core liner A is applied with an adhesive agent by a pasting apparatus 4 to the tops of the other side surface of the corrugated form thereof, and thereafter is further applied with a reinforcing agent D by a reinforcing agent applicator 5 partically to its region in which scored lines for forming a packaging container are to be formed later.

Thereafter the corrugated core liner A is adhered to the other side liner C, so that a sheet of reinforced corrugated cardboard E is formed and thereafter is heated by a heating plate apparatus 6 to heighten a stickness of the bonding agent.

Thereafter, the reinforced corrugated cardboard E is continuaously fed to a slitter-scorer apparatus 7 and thereby is formed with scored lines F thereby before completion of hardening of the reinforcing agent D previously applied to the reinforced corrugated cardboard E as above, and also is cut in any desired width and form.

Thus, since the reinforcing agent D is not yet hardened at the time of forming the scored lines b in the cardboard E by the scorer apparatus 7, the scored lines can be formed in the reinforced region of the reinforced corrugated cardboard without crushing and destroying the structure of that region.

The adhesive agent used in this invention is an aqueous solution mainly composed of corn starch and is gelatinized and is applied to the corrugated core liner A in viscous condition at a temperature of 70° C. to 90° C.

Also, according to this invention, it is so modified that the adhesive agent is used in the form of an aqueous solution of corn starch at the time of application thereof to the corrugated core liner and thereafter the same is gelatinized by the heating the core liner and both the side liners by the heating plate apparatus 6.

As described above, in manufacturing a packaging container made of the reinforced corrugated cardboard, according to this invention, the step of applying the reinforcing agent to the core liner is added in the conventional process of manufacturing of corrugated cardboard. In the case of applying the reinforcing agent thereto, if the application temperature of the reinforcing agent is low, the heating time necessary for strengthening the mutual bonding of those laminated members A, B, C by the heating plate apparatus 6 has to be prolonged. Particularly in such a method that the aqueous solution mainly composed of corn starch is applied to the core liner and thereafter is gelatinized by heating for securing the mutual bonding of the laminated members A, B, C, when the reinforcing agent of a low temperature is applied on the aqueous solution, a heating time has to be extended for gelatinization of the said solution. This results in lowering in the production efficiency of reinforced corrugated cardboards. Accordingly, this problem can be dissolved by preheating the reinforcing agent and then applying the preheated one to the core liner. Especially in the case where the aqueous solution mainly composed of corn starch is applied to the core liner and thereafter is heated to be gelatinized, it is preferable to use the reinforcing agent after preheating it above the gelatinization temperature of the aqueous solution. For instance, as for such a kind of adhesive agents, there may be used Stein-Hall formulation one which is of such a kind that an aqueous solution mainly composed of corn starch is heated to approximately 50° C. to 60° C. to be gelatinized. When this adhesive agent is used, the reinforcing agent should be preheated to about 60° C. or a higher than that, preferably to 75° C. to 85° C. considering its heat radiation loss at the time of application of the reinforcing agent to the core liner.

It will be appreciated that the object of the present invention cannot be attained by using any reinforcing agent having such a property that it is hardened under the temperature condition of a heated plate of the apparatus 6. If, after the reinforcing agent is applied to the core liner A, the adhesive agent is applied to that core liner A, it makes the adhesive agent difficult to attach to the core liner A, so that bonding between the core liner A and the other surface liner C, becomes bad. Therefore, it is preferable to apply the reinforcing agent D after application of the adhesive agent to the core liner A. Accordingly, it is preferable to use any reinforcing agent having such a property as to sufficiently penetrate into the core liner A to which the adhesive agent has already been applied. Furthermore, for the purpose of partially reinforcing only the scored line portions at the time of forming a packaging container, it is preferable to use any reinforcing agent which is suitable for application by spraying.

As a result of study of reinforcing agents it has been confirmed that a reinforcing agent comprising chemically treated or processed starch, water, a surface active agent, and a water resisting agent for starch is especially suitable for the reinforcing agent used for this invention.

Namely, such a reinforcing agent comprises 60 wt.% to 40 wt.% of the processed starch, 40 wt.% to 60 wt.% of water, 0.1 wt.% or less of the surface active agent, and a water resisting agent for starch which is 6 wt.% or more in proportion to a solid content of the processed starch.

For this reinforcing agent, it is required that the same is as high concentration as possible and is as low in water content as possible so as not to deform the corrugation of the core liner when the reinforcing agent is applied to the core liner according to the foregoing condition of this invention, and that it is so low in coefficient of viscosity as to facilitate application thereof by spraying, and its coefficient is preferably 100 cps or less (BH type viscosimeter at 20 rpm) under the temperature condition (20° C. to 80° C.) for corrugated cardboard manufacturing process.

In order to meet these requirements, there is used an aqueous solution thereof comprising 40 wt.% to 60 wt.% of processed starch and 60 wt.% to 40 wt.% of water. As for the processed starch, dextrin, oxidized starch or the like are used, for example, but in view of the strength of a coating film formed on the core liner by application of the reinforcing agent, and of facilitation of the application by spraying, dextrin is preferable.

The reinforcing agent including 40 wt.% to 60 wt.% of the processed starch meets the above described requirements, but because of a comparatively high concentration, it is somewhat unfavorable in penetrating into the core liner, so that in order to shorten the time for penetration into the core liner a surface active agent is added. As for the additive surface active agent, for example, dialkyl sulfosuccinate ester, alkylnaphthalene sulfonate ester, or the like are used, but especially dialkyl sulfosuccinate ester is preferably used because it has a deforming property that is effective in preventing an uneven coating on the core liner caused by foaming of the reinforcing agent, when the reinforcing agent is applied by spraying. Even when an addition amount of the surface active agent exceeds 0.1 wt.%, appreciably improved mechanical strength cannot be observed and rather foaming becomes easier at the time of the spraying application, so that an uniform coating on the core liner cannot be produced.

Thus, in order to accelerate penetration of the reinforcing agent into the core liner, the surface active agent is added, but at the same time a hygroscopic property of the core liner coated with the reinforcing agent is increased, and, if it is left as it is, the water content of the corrugated cardboard is increased to 12 wt.% to 13 wt.%, so that its mechanical strength is lowered. Therefore, in order to increase its resistance to moisture and maintain its mechanical strength, the water resisting agent for starch is added in proportion to the amount of the processed starch.

As for the water resisting agent for starch, for instance, trimethoxy methyl melamine, modified triamide formaldehyde resin, or the like are used. An addition amount of the water resisting agent for starch is 6 wt.% to 10 wt.% on the basis of a solid component, that is, a dry matter of the processed starch, and by addition amount of 6 wt.% or more of the water resisting agent for starch, non-reinforced corrugated cardboard which has a 70% residual strength can be increased in its residual strength. However, by the addition amount thereof exceeding 10%, no appreciable increase in the residual strength is obtained, but rather the chemical reaction of the water resisting agent with the processed starch does not proceed and the water resisting agent for starch is liberated.

Shown below are the results of pressure strength tests on a reinforced corrugated cardboard packaging container produced in accordance with this invention as compared with conventional products:

(Test 1)

Dimensions of the corrugated cardboard container subjected to the tests:
365 mm×255 mm×236 mm
Paper quality:
Front liner: C210
Core liner: S215
Back liner: C180
Region coated with the reinforcing agent:
Coated region in a strip form of 60 mm width including scored lines
Composition of reinforcing agent:
Yellow dextrin 41.6 wt.%
Water 55.2 wt.%
Surface active agent 0.1 wt.%
Water resisting agent (Corresponding to 6.7 wt.% per the dry matter of yellow dextrin): 3.1 wt.%
Composition of bonding agent:
Water 72.25 wt.%
Corn starch 23.73 wt.%
Sodium hydroxide 0.56 wt.%
Borax 0.46 wt.%
Coating amount of the reinforcing agent:

$$40\ g/m^2 \left( \frac{\text{Coating amount g.}}{\text{All area of one side surface } m^2 \text{ of a developed condition of the container}} \right)$$

| Kind of Sample | Test Items | |
|---|---|---|
| | Pressure | Deformation |
| Product by the present invention | 246 kg | 7.8 mm |
| Conventional Product No. 1 | 215 kg | 9.0 mm |
| Conventional Product No. 2 | 207 kg | 9.5 mm |

The conventional product No. 1 is one produced by applying the reinforcing agent to the core liner before feeding the core liner to the corrugator, and the conventional product No. 2 is one made of non-reinforced corrugated cardboard.

(Test 2)

Dimensions of the corrugated cardboard containers subjected to the tests:
308 mm×464 mm×103 mm
Paper quality:
Front liner: K220
Core liner: S160
Back liner: K220
Region coated with the reinforcing agent:
Coating on all areas of the four sides of the container and on a width of 30 mm including the scored lines of the flaps thereof.

The composition of the reinforcing agent and the coating amount thereof are the same as in the test 1.

| Tested Sample | Test Items | |
|---|---|---|
| | Pressure | Deformation |
| Product by the Present Invention A | 662 kg | 14 mm |
| Conventional Product No. 1 B | 526 kg | 15 mm |
| Conventional Product No. 2 C | 431 kg | 16 mm |

The conventional products No. 1 and No. 2 are the same as in the test 1.

Figure 1:
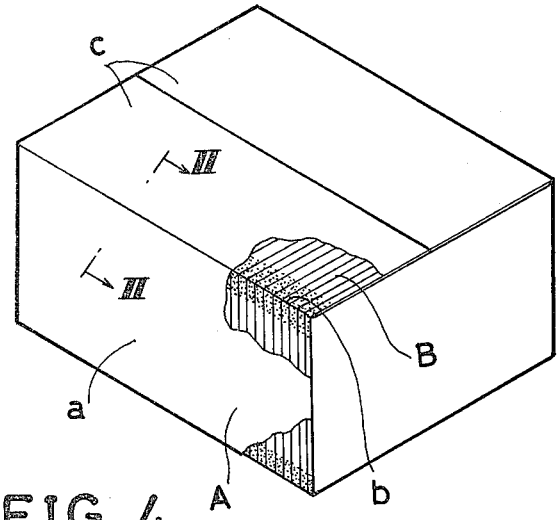
FIG. 1 to FIG. 4 show one example of this invention.
Figure 2:
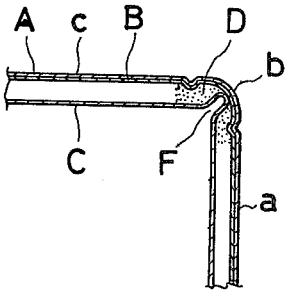
Figure 4:
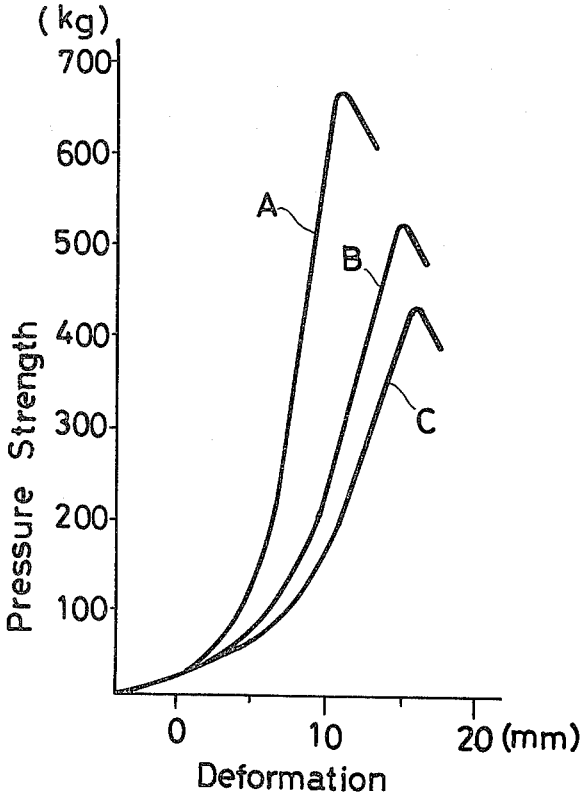
Figure 6:
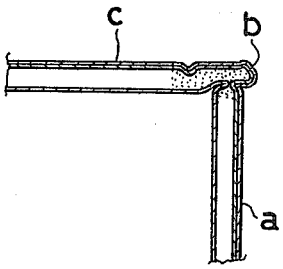
FIG. 6 is a cross-sectional view of a part of another conventional packaging container.
Figure 5:
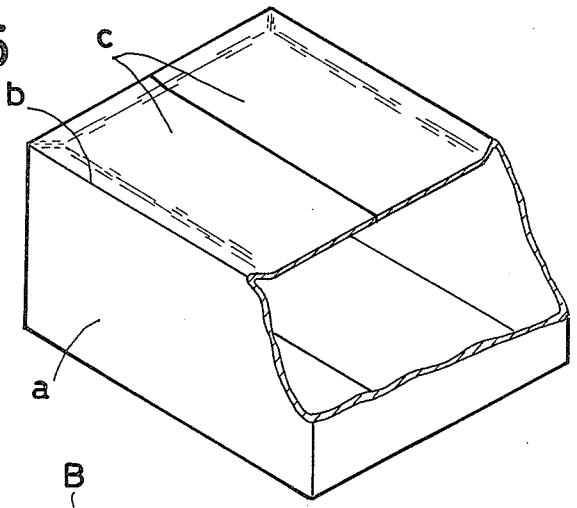
FIG. 5 is a perspective view of a conventional packaging container.

The relationships between the loads applied to the corrugated containers and deformation amounts thereof are shown in FIG. 4.

As clear from the foregoing description, according to this invention, by the corrugator, one side liner and the corrugated core liner are adhered together, and then the corrugated liner thereof is applied with an adhesive agent, and thereafter is further applied with a reinforcing agent, and thereafter is adhered to the other side liner to form reinforced corrugated cardboard, and before completion of hardening of the reinforcing agent, scored lines are formed in the reinforced region of the reinforced corrugated cardboard, so that a reinforced corrugated cardboard packaging container which is improved in resistance to pressure can be provided, without destroying the structure of the scored line portions.

Additionally this invention can be carried out easily only by incorporating a reinforcing agent coating apparatus in any conventional existing corrugator.

What is claimed is:

1. A process of manufacturing a reinforced corrugated cardboard-type of packaging container, comprising the steps of providing a corrugated core liner and a pair of side liners, adhering one side surface of the corrugated core liner to one side liner with an aqueous adhesive solution, applying an aqueous adhesive solution to the other side surface of the corrugated core liner, further applying a reinforcing agent to produce a reinforced region, adhering the other side liner to the other side of the corrugated core liner, heating the two side liners and the corrugated core liner, thereby adhering the side liners and the corrugated core liner together by gelatinizing the aqueous adhesive solutions to form a corrugated cardboard while the reinforcing agent remains unhardened, forming scored lines in said reinforced region before the hardening of the reinforcing agent is completed, and folding the corrugated coardboard in said reinforced region to form a packaging container.

2. A process as claimed in claim 1, wherein the reinforcing agent is composed of 60–40 wt.% of processed starch, 40–60 wt.% of water, 0.1 wt.% or less of surface active agent and water resisting agent for starch which is 0.6 wt.% or more based on a solid content of the foregoing processed starch.

3. A process as claimed in claim 2, wherein when the one side surface of the corrugated core liner is applied with the aqueous solution mainly composed of corn starch and thereafter is further applied with the reinforcing agent, the foregoing reinforcing agent is preheated above the gelatinizing temperature thereof.

* * * * *